United States Patent [19]

Kline

[11] 4,161,113

[45] Jul. 17, 1979

[54] KNOCKOUT ADJUSTMENT MECHANISM FOR FORGING MACHINES

[75] Inventor: Gaylen O. Kline, Tiffin, Ohio

[73] Assignee: The National Machinery Company, Tiffin, Ohio

[21] Appl. No.: 895,363

[22] Filed: Apr. 11, 1978

[51] Int. Cl.[2] ..... B21D 45/00

[52] U.S. Cl. ..... 72/344; 10/11 E; 72/427

[58] Field of Search ..... 72/337, 344, 427, 448; 10/12 T, 11 E

[56] References Cited

U.S. PATENT DOCUMENTS

| | | | |
|---|---|---|---|
| 3,120,769 | 2/1964 | Halebur | 72/427 X |
| 3,559,446 | 2/1971 | Dom et al. | 10/12 T X |
| 3,570,300 | 3/1971 | Schulte | 72/427 |
| 3,802,013 | 4/1974 | Nebendorf | 10/11 E |
| 4,014,203 | 3/1977 | Koch | 72/427 |

FOREIGN PATENT DOCUMENTS

| | | | |
|---|---|---|---|
| 1079300 | 8/1967 | United Kingdom | 10/11 E |

*Primary Examiner*—Leon Gilden

*Attorney, Agent, or Firm*—McNenny, Pearne, Gordon, Gail, Dickinson & Schiller

[57] ABSTRACT

An improved knockout mechanism for forging machines or formers is disclosed in which the position of the knockout pin during the working operation of the machine is adjustably located by a tube nut threaded into the machine frame. In one embodiment, the tube nut is releasably locked in the adjusted position by a plate threaded onto the tube nut having a fulcrum on one side of the tube nut and a jackscrew on the other side at a location spaced from the tube nut greater than the spacing between the fulcrum and the tube nut so that a forced multiplication lever action is provided and secure locking is achieved without excessive jacking forces. In another embodiment, locking is provided by a lock nut threaded on the tube nut and connected to a fulcrum plate by a trunnion. A carriage is provided on the machine frame which supports means to operate the jacking screw and adjust the tube nut from locations accessible to the operator. The tube nut adjustment includes a drive gear and a driven gear automatically maintained in radial alignment by a flange on the drive gear engaging the driven gear on the tube nut. A scale located on the carriage cooperates with a locating flange on the drive gear to provide the operator with a visual indication of the adjustment of the tube nut.

17 Claims, 6 Drawing Figures

KNOCKOUT ADJUSTMENT MECHANISM FOR FORGING MACHINES

BACKGROUND OF THE INVENTION

This invention relates generally to progressive formers or the like, and more particularly to a novel and improved knockout adjusting system for machines of such type.

PRIOR ART

Progressive formers or the like usually provide a die breast in which the dies are mounted. Tools carried by a reciprocating slide cooperate with dies on the breast to form workpieces or blanks to the required shape. Such machines often provide a plurality of work stations and a transfer is provided to progressively position the workpieces at each of the work stations to progressively work the workpiece to the required shape.

In such machines, a knockout system is provided to eject or knock the workpiece out of the die at each work station into the associated transfer. Such knockout systems are generally adjustable to properly position the knockout pin with respect to the dies. Since the knockout pins must usually support forming loads during the forming of the workpiece, the adjustment structure must be quite strong and secure. Consequently, most machines in the past have utilized knockout adjustment systems which are heavy and often difficult and time-consuming to adjust.

In U.S. Pat. No. 3,559,446 (assigned to the assignee of this invention) an improved knockout adjustment system is provided which is structured to reduce the time and effort required to complete the knockout adjustment. The disclosure of such patent is incorporated herein by reference.

SUMMARY OF INVENTION

The present invention is directed to a novel and improved knockout system which is easily operated, provides visual gauge means for determining the adjusted position, and which provides improved locking means to prevent loss of adjustment.

In the illustrated embodiments, the knockout system at each work station includes a tube nut threaded into the machine frame a distance which is adjusted to properly position the knockout pin within the die. Such tube nut is locked in its adjusted position by a lock plate having a fulcrum on one side and a jackscrew on the other side. The jackscrew operates to cause the lock plate to tip or pivot with respect to the tube nut and cause a gripping action which positively locks the tube nut in its adjusted position. Such lock plate replaces the hammer lock nut used in many prior art machines and provides a more reliable structure which is less likely to be damaged in use.

In one illustrated embodiment the lock plate is directly threaded onto the tube nut. In another illustrated embodiment a locking nut is threaded onto the tube nut and is pivotally connected to the lock plate by a trunnion so that eccentric loading or cocking of the tube nut does not occur.

An adjustable frame is provided which is movable from one work station to the next and provides extension means permitting all of the adjustment operations to be performed at readily accessible locations. Such frame includes a driver having a drive gear which meshes with a driven gear on the tube nut to rotate the tube nut in either direction for its adjustment. Gauging is provided by a simple disc locator, which is automatically positioned with respect to the driven gear and provides the operator with a visual indication of the position of the tube nut with respect to the frame during its adjustment. Such driver is adapted for power operation with a power wrench or for manual operation by simple hand tools of a conventional type.

A jackscrew operator mounted on the adjustable frame provides the operator with a readily accessible means for locking and releasing the lock plate.

With the present invention, each of the adjustment operations is easily performed in a reliable manner, and the likelihood of machine damage is substantially reduced.

DETAILED DESCRIPTION OF THE DRAWINGS

Figure 1:
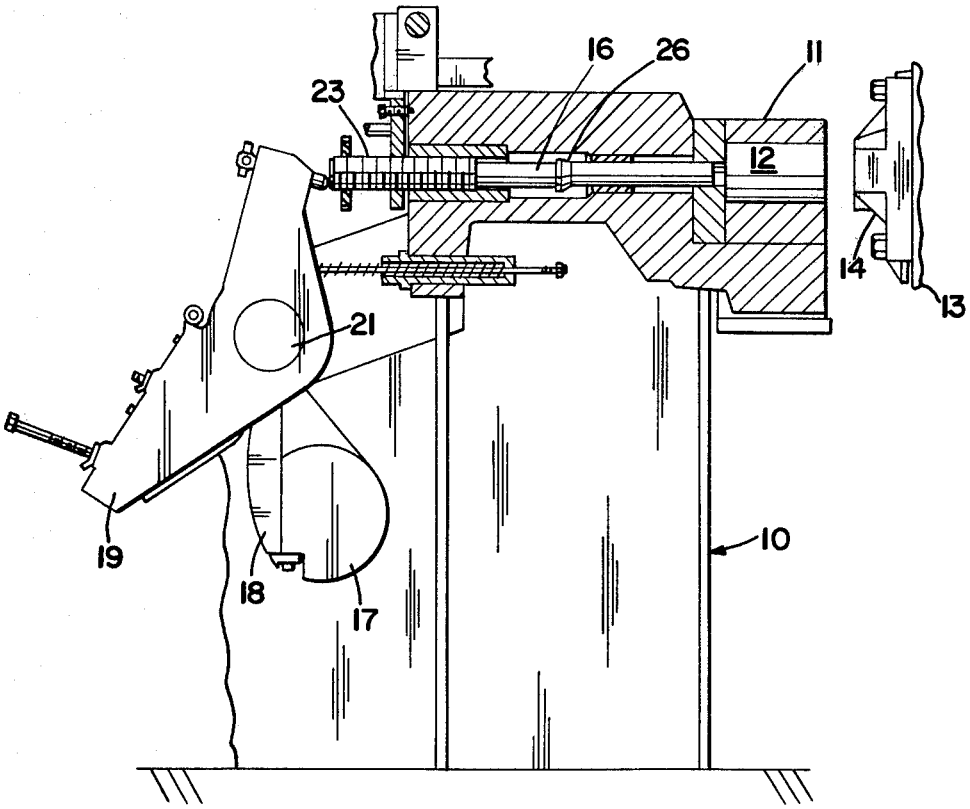
FIG. 1 is a schematic, side elevation of a progressive cold former incorporating the present invention and illustrating the general arrangement of such machine in the areas of the knockout system.
Figure 2:
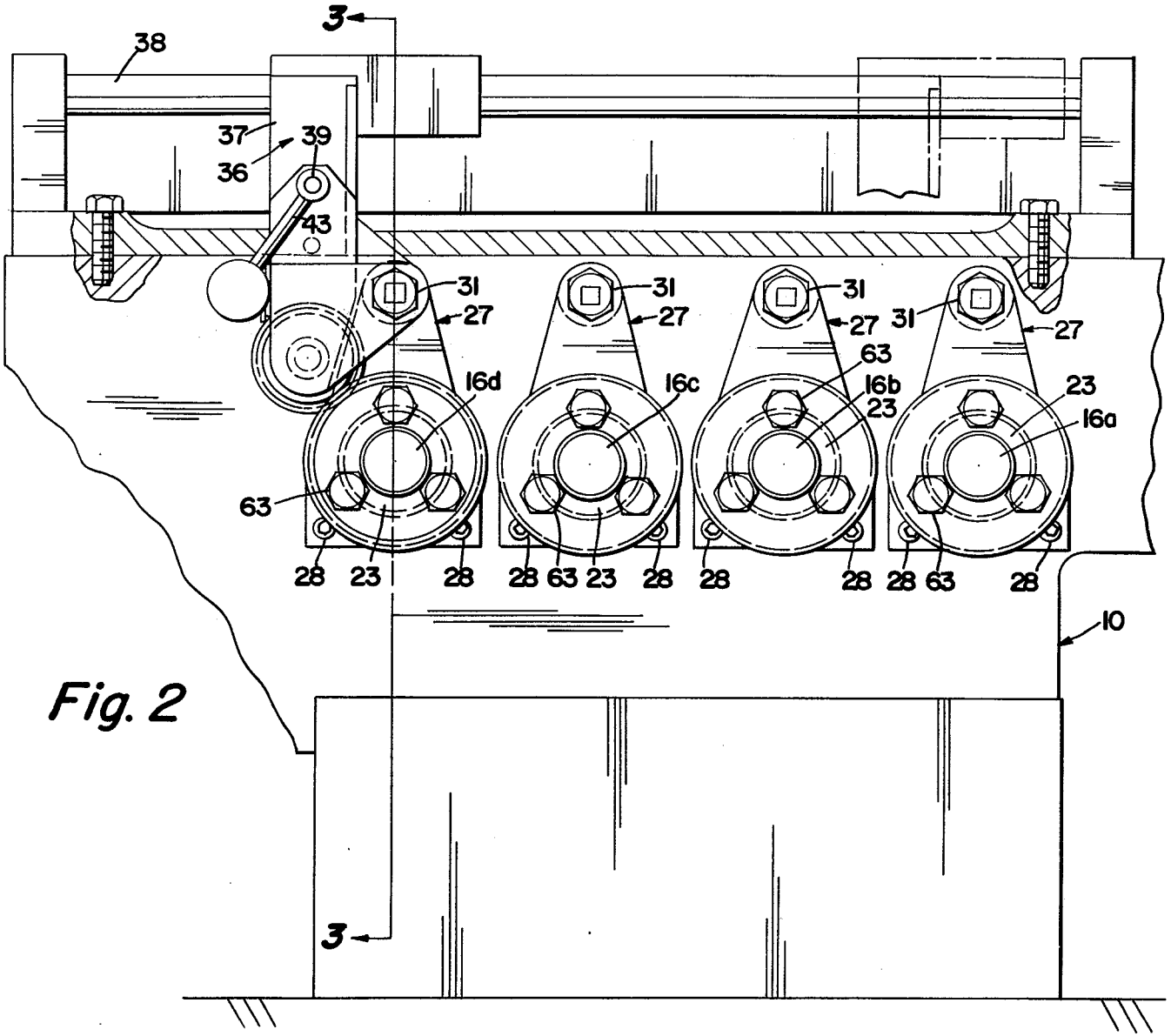
FIG. 2 is an enlarged, fragmentary view, taken along 2—2 of FIG. 1, illustrating the knockout end of the machine with the adjusting frame positioned for adjustment of the knockout at one of the work stations.

FIGS. 1 and 2 illustrate the environment of the preferred embodiments of a kickout system in accordance with the present invention. For purposes of simplification, only the portions of the machine directly associated with the knockout system are illustrated on the drawings. It should be understood, however, that the knockout system in accordance with the invention may be utilized in various types of forging machines well known to those skilled in the art. Such forging machines may be, for example, of the general type illustrated in U.S. Pat. Nos. 3,247,534 and 3,604,242 (both assigned to the assignee of the present invention) and the disclosures of such patents are incorporated herein by reference.

In the drawings, the machine frame is schematically illustrated at 10. Mounted on the frame 10 is a die breast 11 which extends laterally across the frame and supports a plurality of spaced dies 12 in which workpieces or blanks are progressively positioned and worked to the required shape. A slide 13 is carried by the frame 10 for reciprocating movement toward and away from the dies and supports a tool assembly 14 associated with each die 12.

In many machines, the slide is driven by a crank and pinion drive. The tools and dies function in the usual manner to form the workpiece when the slide reaches its forward dead center position. Upon completion of the work cycle, the workpieces or blanks are ejected from the dies into a transfer system (not illustrated) which transports the workpiece to the subsequent die stations for subsequent working by the tools and dies of such subsequent working station.

A knockout assembly is provided for each die station and includes a knockout pin 16 which is longitudinally movable between a retracted or first position which it occupies during the working stroke and a forward or operative position to which it moves to eject the workpiece from the associated die. A rocker shaft 17 extends across the adjacent end of the frame 10 and is journaled for oscillating rotation. A typical drive linkage (not illustrated) connects the rocker shaft to the main crankshaft drive system for the machine so that the rocker shaft is oscillated in timed relationship to the movement of the slide. Mounted on the rocker shaft are a plurality of cams 18, with one cam associated with each of the knockout assemblies. Each cam operates to cause oscillating movement of an associated rocker arm 19 which is journaled on a support shaft 21. The upper end of each rocker arm is provided with an adjusting screw 22 which engages the rearward end of the associated knockout pin 16 and causes the associated pin to move from its rearward position to its operative or forward position for the ejection of the workpiece. Adjustment of the screw 22 adjustably determines the position of the associated knockout pin 16 in its forward position.

The rearward ends of the knockout pins 16 extend through and are supported by associated tube nut 23, which is threaded into a bushing 24 in the frame 10. The adjusted position of each tube nut 23 determines the rearward position of the associated knockout pin. As best illustrated in FIG. 1, each knockout pin is provided with an enlarged shoulder 26 which engages and seats against the forward end of the associated tube nut 23 to determine the rearward-most position of the knockout pin 16. In many instances, forging loads are carried by the knockout pin when it is in its rearward position and during the forming operation performed in the associated die. Therefore, the structure for supporting the knockout pin in such position must be capable of withstanding very high loads even though it is adjustable. Therefore, the tube nut 23 is relatively massive and must be very securely locked in its adjusted position so that the location of the knockout pin is accurately maintained while the machine is running.

In the illustrated machine there are four die stations and four laterally spaced knockout pins 16*a* through 16*d*, as illustrated in FIG. 2. Each of the knockout pins extends through an associated tube nut 23 which adjustably determines the rearward position of the associated knockout pin. Since each knockout assembly at each of the die stations is similar to the other knockout assemblies, only one will be described in detail, with the understanding that such description applies equally to the others.

In the first embodiment of FIGS. 1 thru 4 a lock plate 27 is threaded onto each of the tube nuts 23 and is provided with a pair of fulcrum screws 28 at laterally spaced locations adjacent to its lower end. The lock plate is provided with an upwardly extending projection 29 through which a jackscrew 31 is threaded. The forward end of the jackscrew is formed with a reduced diameter, unthreaded part 32 which fits into a mating cavity 33 in the frame 10. Consequently, the jackscrew 31 prevents the associated locking plates 27 from rotating with respect to the frame when the associated tube nut is threaded in or out for adjustment of the kickout pin positions.

The locking plate operates to securely lock the associated tube nut 23 in the adjusted position by threading the associated jackscrew 31 inwardly. This causes the locking plate to pivot slightly about the fulcrum provided by the screws 28 until the threaded connection between the locking plate 27 and the threads of the screw prevent further pivotal type movement. This action provides very large frictional forces on the tube nut, which locks the tube nut against rotation when the machine operates.

When adjustment of the associated tube nut is required, the associated jackscrew is threaded rearwardly in the manner described below to release the frictional force and allow adjusting rotation of the tube nut. Because the pivot provided by the fulcrum screws 28 is substantially closer to the centerline of the tube nut then the jackscrew 31, a force multiplication results and substantial forces are applied to the tube nut, which has a magnitude susbstantially higher than the forces produced directly by the jackscrew. Consequently, it is not necessary to tighten the jackscrews excessively, and relatively low torque forces are required for the operation of the jackscrew. Further, because the jackscrews have a relatively small diameter, friction resisting their rotation by the locking forces is substantially less than would be required if the locking action were provided by a simple nut threaded onto the tube nut against the frame 10.

Figure 3:
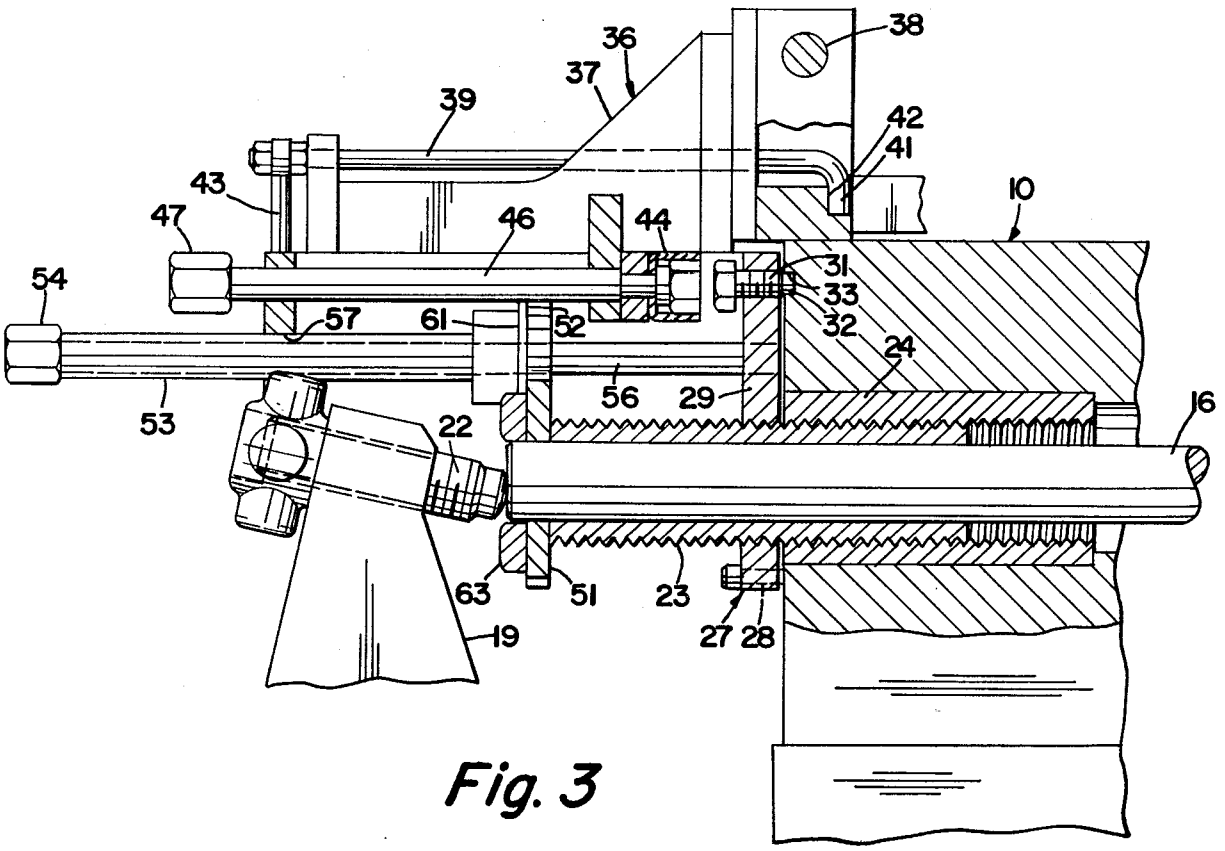
FIG. 3 is an enlarged, fragmentary view, taken generally along 3—3 of FIG. 2, illustrating the general structural arrangement of the adjusting frame.

A simple mechanism, best illustrated in FIGS. 2 and 3, is provided for adjusting the respective tube nuts. Such adjusting mechanism 36 includes a frame 37 supported on a cross shaft 38 on the frame 10 so that it may be pivoted up out of the way and moved lengthwise along the shaft 38 to the proper position for adjusting the knockout system at each of the die stations. In FIG. 2, the adjusting mechanism 36 is illustrated in position for adjusting the left-hand knockout assembly. However, after such adjustment, it can be released, raised and moved over for adjusting each of the other knockouts.

A lock rod 39 is journaled on the frame 37 and is provided with a lateral end portion 41, illustrated in FIG. 3, which extends over a shoulder 42 to prevent the frame 36 from pivoting up around the shaft 38 during the adjusting operation. A handle 43 is mounted on the end of the lock rod 39, permitting the operator to rotate the rod through about 90 degrees until the lateral projection 41 clears the shoulder 42 to allow the frame to be tipped up for movement to an adjacent die station.

When the frame 36 is properly positioned at a given die station, a socket tool 44, mounted on the forward end of the wrenching rod 46 is properly positioned to fit over the hexagonal head of the jackscrew 31. The wrenching rod is mounted on the frame 36 for limited axial movement and for rotation. The rearward end of the wrenching rod is provided with a wrenching head to receive any suitable wrench. Consequently, the tightening and loosening of the jackscrew can be accomplished by sliding the wrenching rod 46 forward until the head of the jackscrew is enclosed within the socket 44 and then by turning the wrenching rod, and in turn the jackscrew, with a suitable wrench placed on the wrenching head 47. With this type of structure, the operation of the jackscrew is easily accomplished at a location which is readily accessible to the operator and it is not necessary to attempt to tighten or loosen the jackscrew in the confined location adjacent to the lock plate.

Adjustment of the tube nut 23 is provided by another drive mechanism provided by the adjusting mechanism 36. Each of the tube nuts 23 is provided with a driven gear 51 at its rearward end. Such gear meshes with the drive gear 52 when the adjusting mechanism is properly positioned. The drive gear 52 is mounted on the forward end of the tubular extension 53 provided with a wrenching end 54. The tubular extension 53 is supported on a rod 56 which extends into the tubular extension and is mounted on the frame 37. Lateral support for the tubular extension 52 is also provided at a bore 57 formed on the frame 37. Consequently, the tubular extension and drive gear 52 are free to rotate with respect to the frame and move axially back and forth to maintain engagement with the driven gear 51 as the tube nut 23 is adjusted.

The shoulder 61 is provided on the tubular extension 52 immediately adjacent to the drive gear 52, which engages the face of the driven gear 51 to maintain the two gears 51 and 52 in proper radial alignment. Therefore, as the tube nut 23 is threaded rearwardly, the tubular extension also moves rearwardly an equal amount. Similarly, when the tube nut 23 is threaded forwardly, the slight pressure applied to the tubular extension 53 by the operator maintains the face of the flange 61 in engagement with the driven gear 51 so the tubular extension moves forward in a similar manner.

Figure 4:
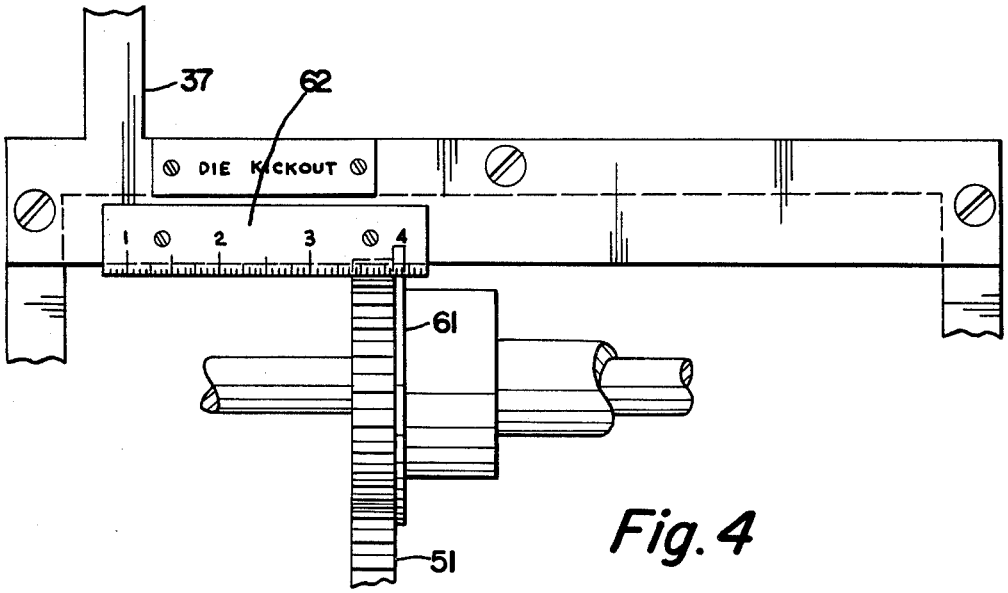
FIG. 4 is a fragmentary side elevation, illustrating the gauging means, which permits the operator to visually determine the position of the tube nut with respect to the frame during its adjustment.

Means to provide the operator with a visual indication of the adjusted position of the tube nut 23 and the driven gear 51 are best illustrated in FIG. 4. Such means includes a scale 62 mounted on the flange 37 adjacent to the flange 61. Therefore, as the tube nut is adjusted, either inwardly or outwardly with the corresponding inward and outward movement of the flange 61, the operator is provided an accessible visual indication of the position of the tube nut with respect to the flange. Such scale is positioned to provided an appropriate indication of the rearward position of the knockout pin 16 with respect to the die adjacent to the rearward end of the machine where the adjusting operations are being performed.

In operation, the adjustment of any one of the knockout pins is performed by releasing the adjusting mechanism 36 by rotating the handle 43 so that the frame can be raised and moved laterally of the machine to the proper position at the die station on which the adjustment is to be performed. The frame is then pivoted down and the frame is locked by rotating the handle 43 back to the position illustrated. The socket 44 is then moved forward to engage and enclosure the head of the associated jackscrew 31 and is turned to thread the jackscrew 31 back to release the associated lock plate 29.

After the lock plate has been released, the tube nut 23 is adjusted by moving the flange 61 and drive gear 52 forward to engage the driven gear 51. A suitable drive device is then connected to the wrenching head 54 and turned to adjust the tube nut. The adjusted position of the tube nut is observed by the position of the flange 61 with respect to the scale 62. When the adjustment is completed, the jackscrew 31 is again tightened to cause the pivotal-type action of the associated plate 29 about the fulcrum screws to lock the tube nut 23 in its adjusted position. The adjusting mechanism 36 can then be released and moved out of the way or to a subsequent die station for further adjustment at such subsequent die station.

It should be understood that the adjusting operations can be performed with typical hand tools applied to the wrenching ends 47 and 54, or that power drive wrenches can be used to perform the adjusting functions. It is also pointed out that the end of each of the tube nuts 23 is provided with three wrenching heads 63, which allow an operator to apply a typical hand wrench and turn the associated tube nut without the use of the adjusting mechanism 36.

Figure 6:
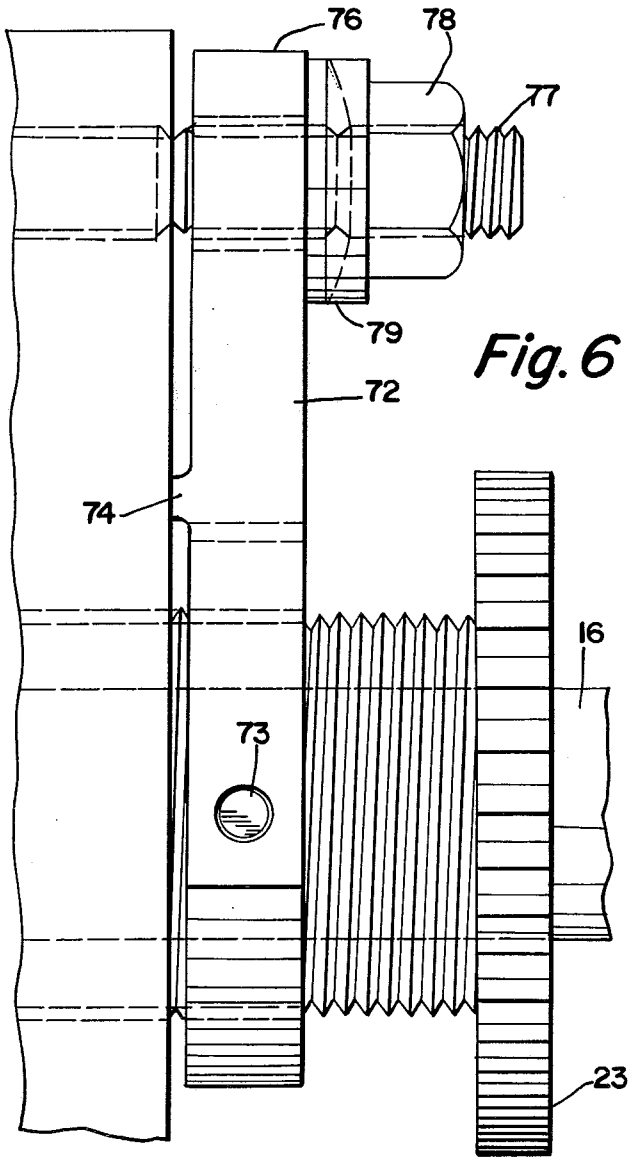
Figure 5:
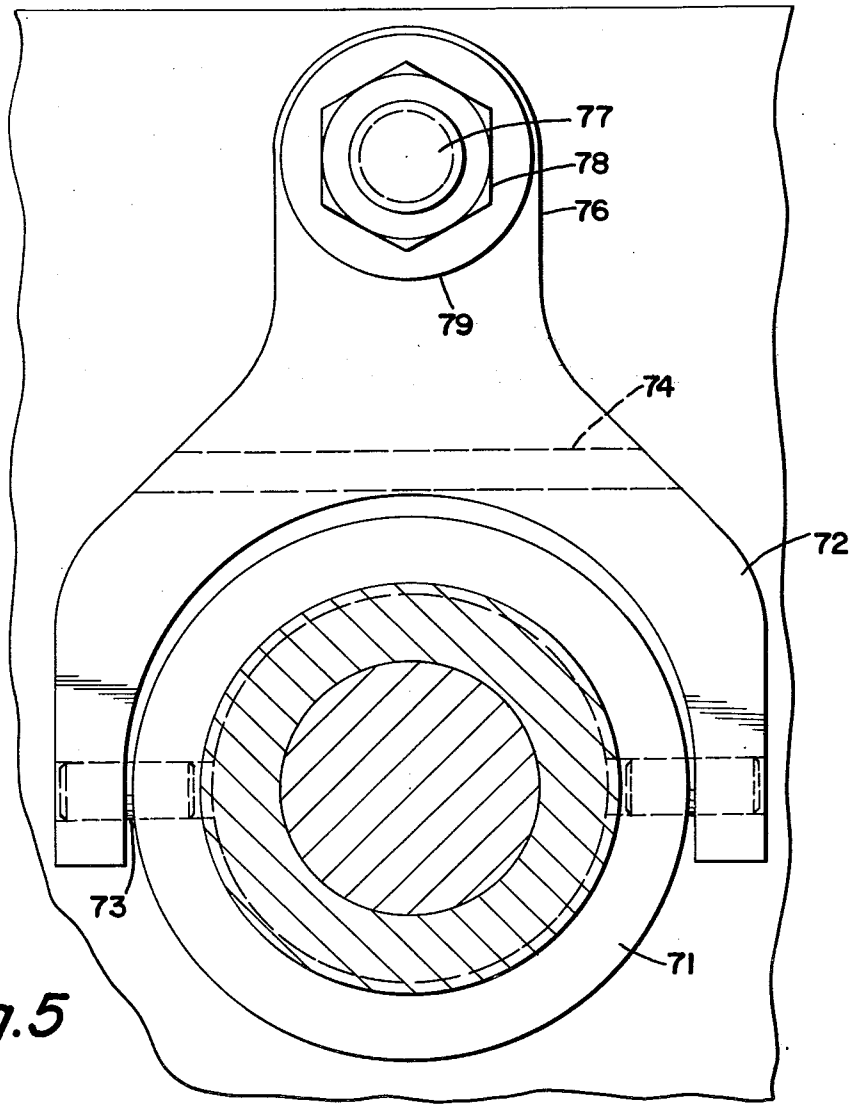
FIG. 5 is a fragmentary view similar to FIG. 2 but illustrating a second embodiment; and, FIG. 6 is a fragmentary side view of the embodiment of FIG. 5.

FIGS. 5 and 6 illustrate another embodiment of this invention in which the tube nut locking system differs slightly from the first embodiment. In this embodiment a lock nut 71 is threaded onto the tube nut 23 in the same manner as the lock plate is threaded onto the tube nut in the first embodiment. Such lock nut is pivotally connected on opposite sides to a fulcrum plate 72 by a pair of opposed pivot pins 73. The fulcrum plate 72 is provided with a fulcrum projection 74 best illustrated in FIG. 6 above the tube nut 23. An upward extension 76 on the fulcrum plate 72 is provided with a bore through which a stud bolt 77 projects. A nut 78 is threaded onto the stud bolt 77 and through a pair of swivel washers 79 operates to clamp or release the fulcrum plate and in turn cause locking or release of the tube nut. When the nut 78 is tightened the fulcrum plate 72 pivots about the fulcrum at 74 and applies a force to the lock nut 71 which causes frictional locking of the tube nut 23. When it is desired to release the locking system to allow adjustment of the tube nut, in the manner described above, the nut 78 is loosened relieving the frictional locking force of the lock nut 71.

The embodiment of FIGS. 5 and 6 because of the trunnion connection with the lock nut prevents eccentric load from being applied to the tube nut and results in an even pressure applied around the periphery of the tube nut. Further with such system, the fulcrum plate 72 is provided with relatively long extensions which are stressed when the locking system is locked and deformed to a slight degree so that a spring action is provided to maintain the locking force and locking friction even if some wear occurs or under vibration conditions.

In the illustrated embodiment of the fulcrum at 74 is located approximately midway between the stud bolts 77 and the center line of the trunnion so a force multiplication is not provided in the locking system. However, if a force multiplication is required for greater locking forces with a given torque on the nut 78 the fulcrum 74 is moved to a location along the arms of the fulcrum plate closer to the location of the trunnion.

For the purposes of this specification, the stud bolt 77 and nut 78 are considered to be embraced within the term jacking means or jack screw and the term lock plate or variations thereof is intended to embrace an assembly consisting of a fulcrum plate and lock nut of the general type illustrated in the second embodiment.

Because the force action of the jackscrew is multiplied significantly by the pivoting and fulcrum action, it is not necessary to apply excessive torque to the jackscrew in order to attain secure locking of the tube nuts. Further in the illustrated embodiments, the ease of adjustment is provided by the extension of the drive system for the jackscrew and the tube nuts to a position on the machine which is readily accessible to the operator.

Although a preferred embodiment of this invention is illustrated, it is to be understood that various modifications and rearrangements may be resorted to without departing from the scope of the invention disclosed and claimed.

I claim:

1. A forging machine comprising a frame, a die on said frame in which blanks are shaped by a tool movable on said frame, and an adjustable knockout assembly on said frame, said knockout assembly including a knockout pin slidable in said frame between a first position occupied during the forming of blanks in said die and an operative position to which it moves to eject a blank from said die, knockout pin stop means threaded into said frame for axial adjustment with the position of said stop means adjustably determining said first position of said knockout pin, said stop means providing a driven gear portion, a drive gear engageable with said driven gear journaled for rotation to cause adjusting rotation of said stop means and movable axially with said stop means as said stop means is axially adjusted, the position of said drive and driven gears providing a visual indication of said first position of said knockout pin during adjustment of said stop means.

2. A forging machine as set forth in claim 1, wherein said stop means is a tube nut threaded into said frame and said knockout pin projects through said tube nut.

3. A forging machine as set forth in claim 2, wherein said drive gear is part of said tube nut, and alignment means are provided to maintain radial alignment between said drive and driven gears as the tube nut is adjusted.

4. A forging machine as set forth in claim 3, wherein said alignment means includes a flange engaging the side of said driven gear, and scale means are provided adjacent to said flange to provide a visual indication of said adjustment of said first position.

5. A forging machine as set forth in claim 4, wherein said machine includes a plurality of work stations, each providing a substantially similar knockout assembly, and said drive gear and said scale means are supported on a carriage supported on said frame and movable to each work station for adjusting the respective knockout assemblies.

6. A forging machine as set forth in claim 5 wherein lock means are threaded on said tube nut, said lock means providing fulcrum means and jacking means, operation of said jacking means causing said lock means to pivot about said fulcrum and produce frictional locking of said tube nut.

7. A forging machine as set forth in claim 6 wherein said lock means includes a lock nut threaded on said tube nut, and said fulcrum means is connected to said lock nut by a connection which allows said fulcrum means to pivot about its fulcrum without corresponding pivotal movement of said lock nut.

8. A forging machine as set forth in claim 7 wherein said fulcrum means and said lock nut are connected by a trunnion connection allowing pivotal movement therebetween.

9. A forging machine as set forth in claim 8, wherein said carriage is provided with an extension for operating said jacking means from an accessible location, and said drive gear is also provided with an extension for adjusting said tube nut from an accessible location.

10. A forging machine as set forth in claim 5, wherein lock means are threaded on said tube nut, said lock means providing fulcrum means on one of side of the axis of said tube nut and jacking means on the other side of said axis of said tube nut and spaced therefrom by a distance substantially greater than said fulcrum means, operation of said jacking means causing said lock means to pivot about said fulcrum and produce frictional locking of said tube nut.

11. A forging machine as set forth in claim 2, wherein lock means are threaded onto said tube nut, said lock means providing fulcrum means spaced from the axis of said tube nut and a jackscrew spaced from said fulcrum means operation of said jackscrew causing said lock means to pivot about said fulcrum means and produce frictional locking of said tube nut.

12. A forging machine as set forth in claim 11, wherein extension means are provided to operate said drive gear and said jackscrew from locations accessible to an operator, and said extension means are movable to a position remote from said knockout assembly.

13. A forging machine comprising a frame, a die in said frame in which blanks are shaped by a tool movable on said frame, and an adjustable knockout assembly on said frame, said knockout assembly including a knockout pin slidable in said frame between a first position occupied during forming of blanks in said die and an operative position to which it moves to eject the blank from said die, a tube nut threaded into said frame for axial adjustment with the position of said tube nut adjustably determining said first position of said knockout pin, and a lock plate means threaded onto said tube nut, a fulcrum for said lock plate means spaced from the axis of said tube nut, and a jack means on said lock plate means spaced from said fulcrum, release of said jack means allowing rotation of said tube nut with respect to said frame and substantially free rotation of said tube nut with respect to said lock plate means, operation of said jack means causing said lock plate means to pivot with respect to said fulcrum and with respect to said tube nut for creating substantial friction preventing rotation of said tube nut with respect to said frame.

14. A forging machine as set forth in claim 13, wherein said jack means is spaced from said fulcrum a distance substantially greater than the spacing between said fulcrum and said axis of said tube nut.

15. A forging machine as set forth in claim 14 wherein said lock plate means includes a lock plate threaded onto said tube nut, said fulcrum being located on one side of said tube nut and said jack means being located on the other side of said tube nut, said fulcrum being provided by a pair of screws threaded into said lock plate at spaced locations along a fulcrum line.

16. A forging machine as set forth in claim 13 wherein said lock plate means includes a lock nut threaded onto said tube nut and a fulcrum plate pivotally connected to said lock nut, said fulcrum plate providing a fulcrum on the same side of the axis of said tube nut and said jack means.

17. A forging machine as set forth in claim 13, wherein the said machine includes a plurality of work stations each providing a substantially similar knockout assembly, with each tube nut including a driven gear, and a carriage supported on said frame movable to each work station for adjusting the respective knockout assemblies, a drive gear mounted on said carriage engageable with the driven gear of an associated tube nut and movable therewith with respect to said carriage as said tube nut is adjusted, operating means on said carriage for engaging and operating an associated jackscrew means, said operating means and said drive gear each providing extensions to permit operation thereof from accessible locations.

* * * * *